US006585013B2

(12) United States Patent
Gamberini

(10) Patent No.: US 6,585,013 B2
(45) Date of Patent: Jul. 1, 2003

(54) MACHINE FOR FILLING CAPSULES WITH AT LEAST ONE PRODUCT

(75) Inventor: Ernesto Gamberini, Rastignano (IT)

(73) Assignee: H.P.F. S.r.l., Pianoro (IT)

( * ) Notice: Subject to any disclaimer, the term of this patent is extended or adjusted under 35 U.S.C. 154(b) by 0 days.

(21) Appl. No.: 10/098,887

(22) Filed: Mar. 15, 2002

(65) Prior Publication Data

US 2002/0170619 A1 Nov. 21, 2002

(30) Foreign Application Priority Data

Mar. 16, 2001 (IT) ..... BO01A0147

(51) Int. Cl.[7] ..... B65B 1/00

(52) U.S. Cl. ..... 141/146; 141/71; 141/81; 141/144; 141/238; 141/242; 141/258; 141/270

(58) Field of Search ..... 141/12, 71, 73, 141/80, 81, 144–146, 181, 234, 237, 238, 242–246, 248, 251, 258, 263, 270, 284, 152

(56) References Cited

U.S. PATENT DOCUMENTS

| | | | | |
|---|---|---|---|---|
| 3,656,517 A | * | 4/1972 | Taylor et al. | 141/1 |
| 4,062,386 A | | 12/1977 | Zanasi | 141/258 |
| 4,915,146 A | | 4/1990 | Warner | 141/144 |
| 5,022,443 A | | 6/1991 | Warner | 141/129 |
| 5,082,032 A | * | 1/1992 | Crocker | 141/1 |
| 5,396,936 A | * | 3/1995 | Nalbach et al. | 141/144 |
| 5,605,183 A | * | 2/1997 | Hartman et al. | 141/237 |
| 5,626,171 A | | 5/1997 | Mirri | 141/152 |
| 6,098,675 A | * | 8/2000 | Runft | 141/81 |
| 6,286,567 B1 | * | 9/2001 | Runft | 141/145 |

FOREIGN PATENT DOCUMENTS

| | | |
|---|---|---|
| DE | 2204500 | 2/1972 |
| DE | 3907182 | 9/1989 |
| EP | 0678449 | 4/1995 |
| FR | 2306679 | 4/1976 |

* cited by examiner

*Primary Examiner*—J. Casimer Jacyna
(74) *Attorney, Agent, or Firm*—Frost Brown Todd LLC

(57) ABSTRACT

A continuous machine for filling the bottom shells of capsules with at least one product has a conveyor for feeding the bottom shells along a given path; and at least one metering wheel having a number of metering devices, each for supplying a relative bottom shell with a given quantity of product withdrawn from a container, which is mounted eccentrically with respect to the metering wheel and is supplied by means of at least one conduit extending downwards inside a space enclosing the container and the metering wheel.

9 Claims, 5 Drawing Sheets

MACHINE FOR FILLING CAPSULES WITH AT LEAST ONE PRODUCT

The present invention relates to a machine for filling capsules with at least one product.

More specifically, the present invention relates to a machine for filling capsules—each comprising a bottom shell and a top shell fitted to the bottom shell—with at least one powdered pharmaceutical product, to which the following description refers purely by way of example.

BACKGROUND OF THE INVENTION

In the pharmaceutical industry, a capsule filling machine is employed comprising a conveyor which moves continuously along a given path and has a number of pockets equally spaced along the path, and each for receiving a respective bottom shell.

The machine also comprises a metering wheel mounted to rotate continuously about a central axis of symmetry, and having a number of metering devices, which are equally spaced about said axis with the same spacing as the pockets, move with the metering wheel along a portion of said path, each in time with a relative pocket, and move with respect to the metering wheel in a direction parallel to the metering wheel axis.

The machine also comprises an annular container housing the powdered pharmaceutical product, and which is mounted to rotate continuously about a further central axis of symmetry parallel to and eccentric with respect to the metering wheel axis, so that each metering device is first positioned facing the container to withdraw a given quantity of pharmaceutical product from the container, and is then positioned facing and coaxial with a relative bottom shell, into which it feeds the withdrawn pharmaceutical product.

Since the container is supplied by a hopper extending radially outwards from the outer periphery of the container, known machines of the above type are relatively bulky.

BRIEF SUMMARY OF THE INVENTION

It is an object of the present invention to provide a machine for filling capsules with at least one pharmaceutical product, designed to eliminate the aforementioned drawback.

According to the present invention, there is provided a machine for filling capsules with at least one product, each capsule comprising a bottom shell and a top shell; the machine comprising a conveyor moving continuously along a given path and having a number of pockets, each for receiving a respective bottom shell; at least one metering wheel rotating continuously about a first axis, and having a number of metering devices moving with the metering wheel along a portion of said path, each in time with a relative said pocket, to feed a given quantity of said product into a relative said bottom shell; a container housing said product and moving about a second axis substantially parallel to said first axis, each said metering device withdrawing the relative said quantity of product from said container; and supply means for feeding said product into said container; and being characterized in that said supply means comprise at least one supply conduit extending downwards inside a space enclosing said metering wheel and said container.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
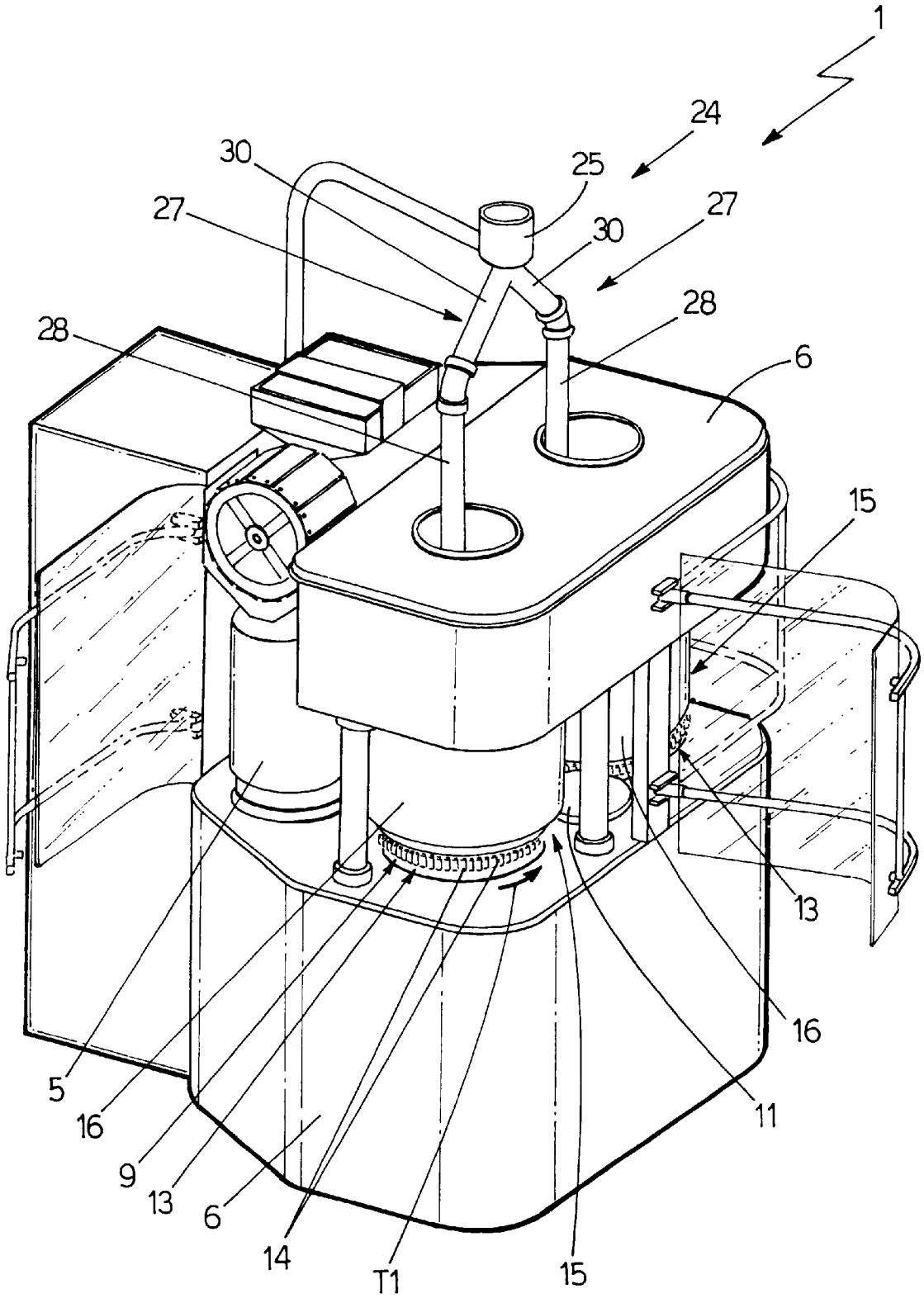
FIG. 1 shows a schematic view in perspective of a preferred embodiment of the machine according to the present invention.
Figure 2:
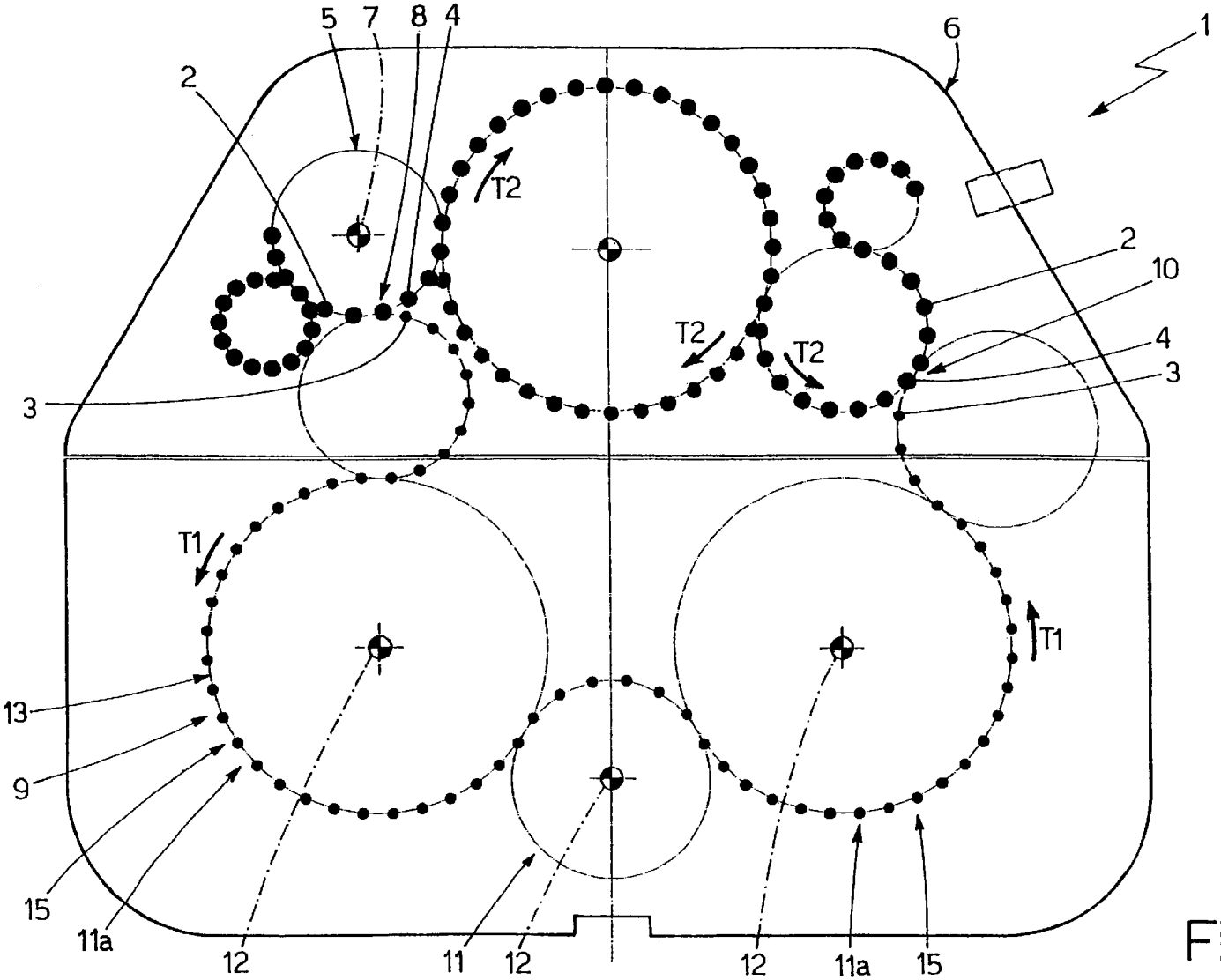
FIG. 2 shows a schematic plan view illustrating the operating principle of the FIG. 1 machine.

With reference to FIGS. 1 and 2, number 1 indicates as a whole a machine for filling known capsules 2 with a powdered pharmaceutical product; each capsule 2 comprising a substantially cup-shaped bottom shell 3, and a top shell 4 fitted to bottom shell 3.

Machine 1 comprises a supply wheel 5 fitted to a fixed frame 6 of machine 1 to rotate continuously, with respect to frame 6 and in a given direction (anticlockwise in FIG. 2), about an axis 7 perpendicular to the FIG. 1 plane. Wheel 5 feeds the empty capsules 2 successively to an opening and separating station 8, where the empty capsules 2 are opened, and bottom shells 3 are picked up successively by a conveyor device 9 for feeding each bottom shell 3 along a filling path T1 to a closing station 10, where bottom shell 3 is closed with a respective top shell 4. In connection with the above, it should be pointed out that each top shell 4 is fed between stations 8 and 10 along a path T2 shaped so that the bottom shell 3 and top shell 4 separated at station 8 arrive at station 10 in time with each other.

Figure 3:
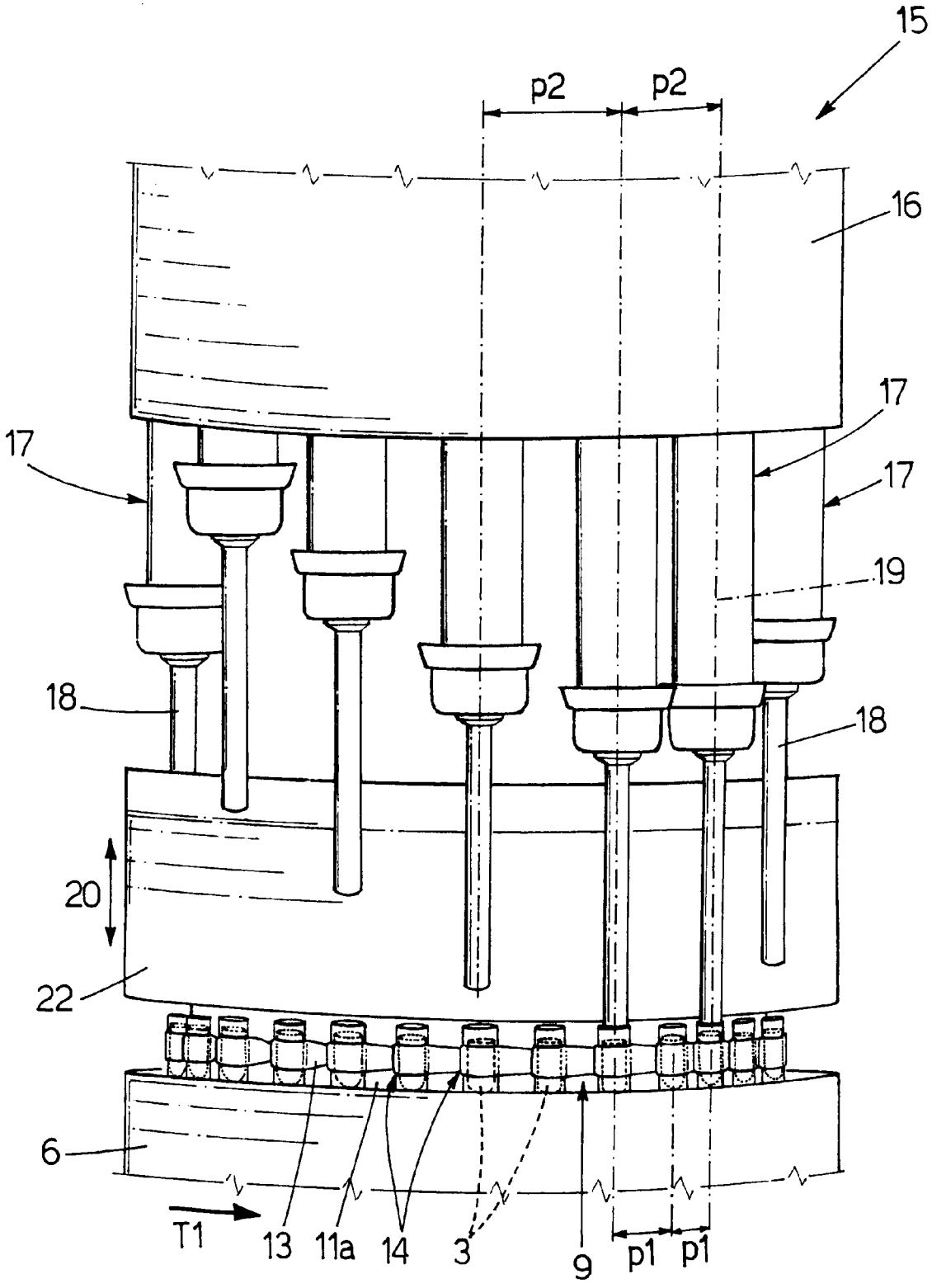
FIG. 3 shows a schematic side view of a detail of the FIG. 1 machine.

Device 9 comprises a number of powered sprockets 11 (one coaxial with wheel 5) connected to one another by a known gear transmission (not shown) to rotate continuously about respective axes 12 substantially parallel to one another and to axis 7. With reference to FIG. 3, device 9 also comprises a conveyor chain 13 looped about sprockets 11 and having a number of pockets 14, which are substantially cup-shaped with the concavity facing upwards, are equally spaced along chain 13 with a spacing p1, each receive a respective bottom shell 3 with its concavity facing upwards, and are fed by chain 13 along path T1.

Machine 1 also comprises two metering wheels 15 located in series along path T1 and having respective drums 16, which are coaxial with relative sprockets 11 (hereinafter referred to as sprockets 11*a*) and are connected in angularly fixed manner to relative sprockets 11*a* to rotate continuously, with respect to frame 6, about relative axes 12 at the same angular speed as relative sprockets 11*a*.

Each wheel 15 has a number of known metering devices 17, which are equally spaced along the periphery of relative drum 16 with a spacing p2 substantially equal to twice spacing p1, and are fed by relative drum 16 along a portion of path T1 extending about relative axis 12, each in time with a relative bottom shell 3.

Since devices 17 on each wheel 15 are spaced about relative axis 12 with a spacing p2 substantially equal to twice the spacing p1 of pockets 14 along chain 13, the bottom shells 3 filled by devices 17 on each wheel 15 alternate with the bottom shells 3 filled by devices 17 on the other wheel 15.

Obviously, n number of wheels 15 may be provided along path T1, each having a respective number of devices 17 equally spaced about relative axis 12 with a spacing p2 substantially equal to the n number of wheels 15 multiplied by the spacing p1 of bottom shells 3 along chain 13.

Each device 17 comprises a sleeve 18, which has an axis 19 substantially parallel to axes 12, is connected in angularly fixed, axially sliding manner to drum 16, and is moved linearly in a direction 20 parallel to axis 12 by a known cam actuating device not shown.

Each device 17 also comprises a piston 21, which engages relative sleeve 18 in axially sliding, angularly fixed manner, and is moved linearly, with respect to relative sleeve 18 and in direction 20, by a further known cam actuating device not shown.

Figure 4:
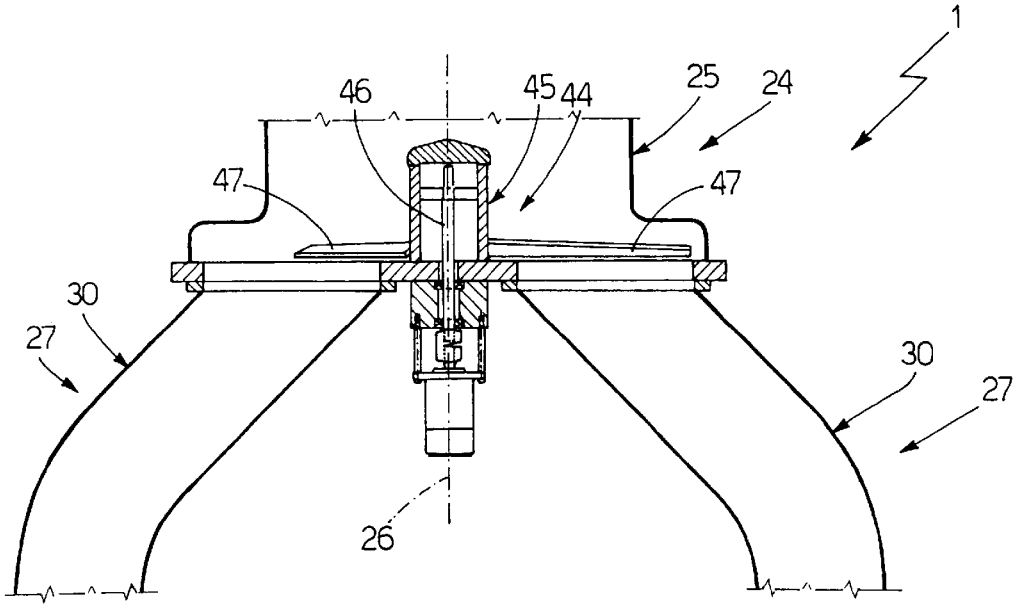
FIG. 4 shows a schematic axial section, with parts removed for clarity, of the FIG. 3 detail.
Figure 4:
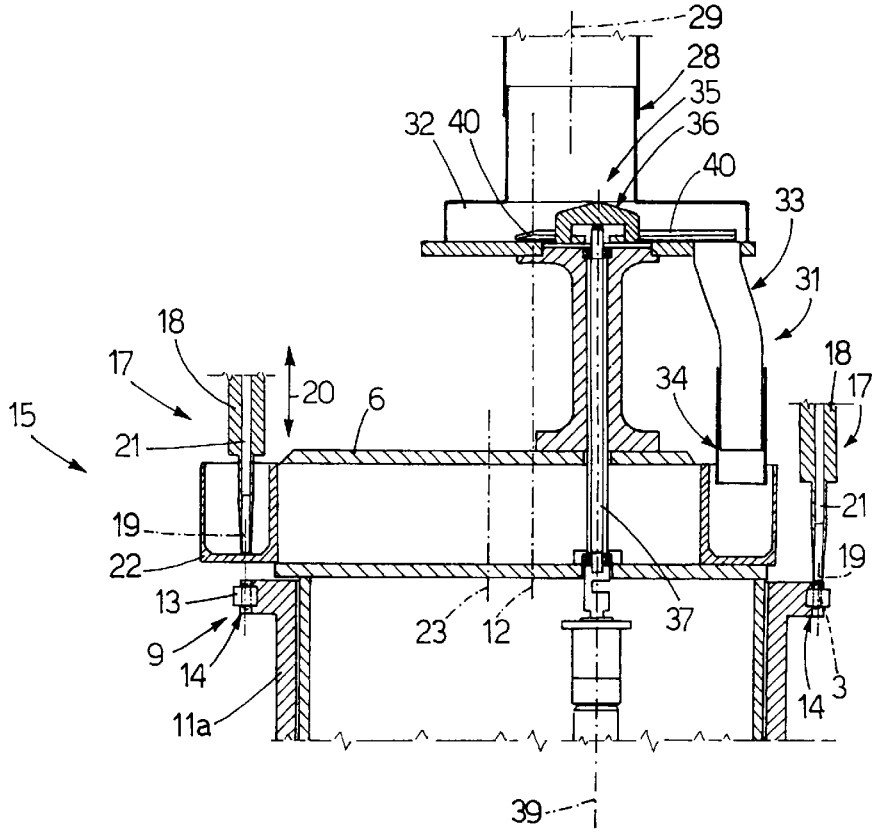
Figure 5:
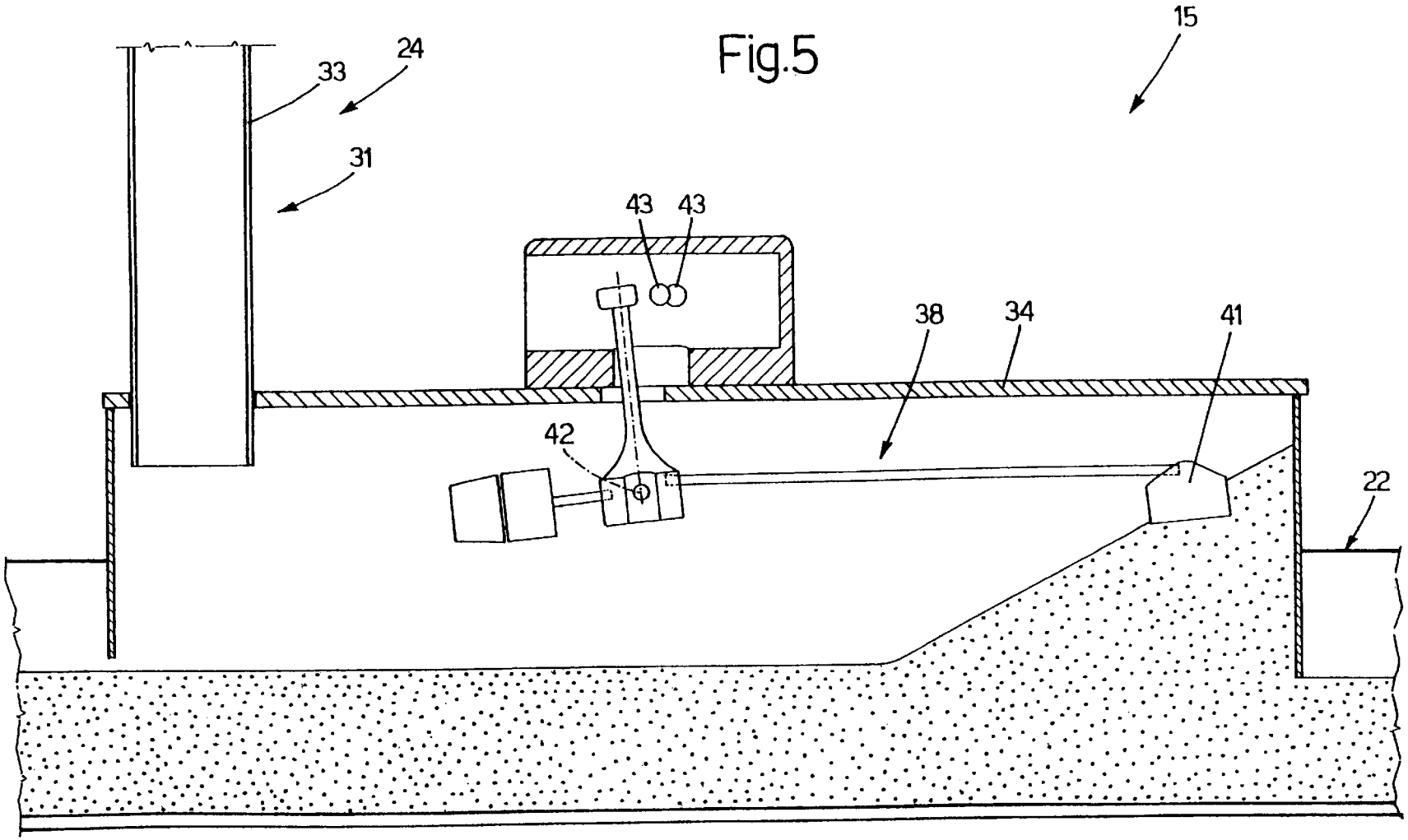
FIG. 5 shows a schematic side view, with parts in section and parts removed for clarity, of a detail in FIG. 4.

With reference to FIG. 4, each wheel 15 is associated with an annular container 22, which houses said powdered pharmaceutical product, is located between sprocket 11*a* and drum 16, and is fitted to frame 6 to rotate continuously, with respect to frame 6, about an axis 23 substantially parallel to axis 12, and at a substantially different angular speed from the angular speed of the whole defined by drum 16 and sprocket 11*a*.

Container 22 being mounted eccentrically with respect to the whole defined by drum 16 and sprocket 11*a*, the circular trajectory of each device 17 about axis 12 is divided into two portions: one portion at which device 17 is positioned facing container 22, and is moved axially to and from container 22 by the combined action of said two cam actuating devices (not shown) to withdraw a given quantity of pharmaceutical product from container 22; and another portion at which device 17 is positioned facing relative pocket 14, and is moved axially to and from pocket 14 by the combined action of the two cam actuating devices (not shown) to feed the withdrawn pharmaceutical product into the relative bottom shell 3.

With reference to FIGS. 1 and 4, the machine also comprises a supply unit 24 for feeding the pharmaceutical product to containers 22, and which comprises a fixed central hopper 25 common to containers 22, having a longitudinal axis 26 substantially parallel to axes 12 and 23, and located over and between wheels 15 and at a distance, from the plane defined by path T1, substantially greater than the height of each wheel 15 measured parallel to relative axis 12.

For each container 22, unit 24 comprises a supply conduit 27 connecting hopper 25 to relative container 22, and in turn comprising an intermediate portion 28 with a longitudinal axis 29 substantially parallel to relative axes 12 and 23, an end portion 30 connecting portion 28 to hopper 25, and an end portion 31 connecting relative container 22 to a hold chamber 32 interposed between portions 28 and 31.

More specifically, portion 31 comprises a pipe 33 extending downwards from chamber 32; and a tubular appendix 34, which is substantially in the form of an annular sector, projects inside container 22, and is connected to pipe 33 to slide linearly in direction 20, so as to selectively adjust the thickness of the layer of pharmaceutical product inside container 22.

Supply of the pharmaceutical product from chamber 32 to portion 31 is controlled by a dispensing device 35 comprising a rotor 36, which is housed inside chamber 32 and is fitted to a powered shaft 37 to rotate about an axis 39, substantially parallel to axis 29, in response to a signal from a control device 38 housed inside appendix 34. Rotor 36 has a number of (in the example shown, three) blades 40 equally spaced about and extending radially outwards from axis 39 to feed the pharmaceutical product, in use, to pipe 33 and, therefore, to container 22.

Device 38 comprises a float 41 mounted for rotation inside appendix 34 so as to oscillate, with respect to appendix 34 and about an axis 42 substantially crosswise to axis 39, as a function of the level of pharmaceutical product inside appendix 34; and two sensors 43 for respectively controlling rotation of rotor 36 and stopping machine 1, as a function of the angular position of float 41 about axis 42.

In a variation not shown, rotor 36 is replaced by a screw fitted inside chamber 32 to rotate about an axis crosswise to axes 29 and 42 in response to a signal from device 38.

Unit 24 also comprises a device 44 for mixing the pharmaceutical product inside hopper 25. Device 44 comprises a rotor 45, which is housed inside hopper 25, is fitted to a powered shaft 46 coaxial with axis 26 to rotate continuously about axis 26, and has a number of (in the example shown, three) blades 47 equally spaced about and extending radially outwards from axis 26.

As will be clear from the foregoing description, supplying containers 22 by means of a single hopper 25 located over metering wheels 15, and by means of supply conduits 27, each extending downwards inside a respective space enclosing relative metering wheel 15 and relative container 22, provides for achieving a relatively compact machine 1.

What is claimed is:

1. A machine for filling capsules (2) with at least one product, each capsule (2) comprising a bottom shell (3) and a top shell (4); the machine comprising a conveyor (9) moving continuously along a given path (T1) and having a number of pockets (14), each for receiving a respective bottom shell (3); at least one metering wheel (15) rotating continuously about a first axis (12), and having a number of metering devices (17) moving with the metering wheel (15) along a portion of said path (T1), each in time with a relative said pocket (14), to feed a given quantity of said product into a relative said bottom shell (3); a container (22) housing said product and moving about a second axis (23) substantially parallel to said first axis (12), each said metering device (17) withdrawing the relative said quantity of product from said container (22); and supply means (24) for feeding said product into said container (22); and being characterized in that said supply means (24) comprise at least one supply conduit (27) extending downwards inside a space enclosing said metering wheel (15) and said container (22).

2. A machine as claimed in claim 1, wherein said supply means (24) also comprise a hopper (25) for feeding said product to said conduit (27); the hopper (25) being located over said metering wheel (15).

3. A machine as claimed in claim 2, and also comprising mixing means (44) for mixing said product in said hopper (25).

4. A machine as claimed in claim 1, wherein said conduit (27) comprises at least two tubular portions (28, 31) arranged in series; and dispensing means (35) for controlling supply of said product between said tubular portions (28, 31).

5. A machine as claimed in claim 4, wherein said conduit (27) also comprises a hold chamber (32) interposed between, and communicating with, said tubular portions (28, 31); said dispensing means (35) comprising a bladed rotor (36) housed in said hold chamber (32) and movable about a third axis (39), substantially parallel to said first and said second axis (12, 23), to feed said product, in use, to a first (31) of said tubular portions (28, 31).

6. A machine as claimed in claim 5, wherein said first tubular portion (31) projects inside said container (22); control means (38) controlling operation of said bladed rotor (36), and comprising at least one float (41) housed substantially in said first tubular portion (31) and movable about a fourth axis (42), substantially crosswise to said first, said second, and said third axis (12, 23, 39), as a function of the product inside said first tubular portion (31).

7. A machine as claimed in claim 2, wherein said control means (38) also comprise at least two sensor elements (43) for respectively controlling operation of said bladed rotor (36) and of the machine as a function of the angular position of said float (41) about said fourth axis (42).

8. A machine as claimed in claim 1, and comprising a number of said metering wheels (15); said supply means (24) comprising a said conduit (27) for each said metering wheel (15), and a single hopper (25) for supplying said conduits (27) and located over said metering wheels (15).

9. A machine as claimed in claim 1, wherein said product is a pharmaceutical product.

* * * * *